US011603249B2

(12) United States Patent
Takeshita et al.

(10) Patent No.: US 11,603,249 B2
(45) Date of Patent: Mar. 14, 2023

(54) PACKING DEVICE

(71) Applicant: SEIKO EPSON CORPORATION, Tokyo (JP)

(72) Inventors: Sanshiro Takeshita, Shiojiri (JP); Koji Nishimaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/367,087

(22) Filed: Jul. 2, 2021

(65) Prior Publication Data

US 2022/0009692 A1 Jan. 13, 2022

(30) Foreign Application Priority Data

Jul. 13, 2020 (JP) ..... JP2020-119733

(51) Int. Cl.
*B65D 81/02* (2006.01)
*B65D 85/30* (2006.01)
*B65D 81/05* (2006.01)

(52) U.S. Cl.
CPC ..... *B65D 81/057* (2013.01); *B65D 2581/053* (2013.01)

(58) Field of Classification Search
CPC .. B65D 81/053; B65D 81/056; B65D 81/057; B65D 2581/053
USPC ..... 206/453, 586, 591, 592, 594
See application file for complete search history.

(56) References Cited

U.S. PATENT DOCUMENTS 1,786,189 A * 12/1930 Bowersock ..... B65D 5/5033 206/586
2,271,265 A * 1/1942 Kirby ..... B65D 81/056 217/3 BC
3,302,782 A * 2/1967 Pezely, Jr. ..... B65D 81/057 217/53
3,410,474 A * 11/1968 Keil ..... B65D 81/056 297/DIG. 2
3,836,043 A * 9/1974 Levin ..... B65D 81/056 206/586
4,134,496 A * 1/1979 Smith ..... B65D 81/057 206/453
6,268,039 B1 * 7/2001 Chou ..... B65D 5/5069 206/583
6,488,153 B1 * 12/2002 Morris ..... B65D 81/056 206/523

(Continued)

FOREIGN PATENT DOCUMENTS

JP 2010173667 A 8/2010

*Primary Examiner* — Luan K Bui
(74) *Attorney, Agent, or Firm* — Chip Law Group

(57) ABSTRACT

A packing device includes an object to be packed, a packing box, and a cushioning part arranged between the object to be packed and an inner wall of the packing box. The cushioning part is formed of first to fourth cushioning elements assembled together. The cushioning part in an assembled state can be disassembled by having the first to fourth cushioning elements move in a direction of disassembly. The second cushioning element and the third cushioning element forming the cushioning part have a multilayer structure formed of plate-like members stacked on each other. The first to fourth cushioning elements forming the cushioning part are in contact with the object to be packed or the inner wall of the packing box and thus have their movement in the direction of disassembly regulated.

6 Claims, 8 Drawing Sheets

(56) References Cited

U.S. PATENT DOCUMENTS

| | | | | |
|---|---|---|---|---|
| 8,752,707 | B2 * | 6/2014 | McDonald | B65D 81/057 53/472 |
| 2017/0349351 | A1 * | 12/2017 | Fujihara | B65D 43/02 |

* cited by examiner

PACKING DEVICE

The present application is based on, and claims priority from JP Application Serial Number 2020-119733, filed Jul. 13, 2020, the disclosure of which is hereby incorporated by reference herein in its entirety.

BACKGROUND

1. Technical Field

The present disclosure relates to a packing device.

2. Related Art

According to the related art, a packing device having a packing box and a cushioning part arranged between an object to be packed that is accommodated in the packing box and the packing box is known. For example, in JP-A-2010-173667, a cushioning part is formed of a plurality of block-like cushioning elements, and these cushioning elements are held between a packing box and an object to be packed.

Forming the cushioning part of a plurality of cushioning elements as in the related-art packing device enables the cushioning part to easily correspond to the shape of the object to be packed and thus satisfactorily protect the object to be packed. However, if the plurality of cushioning elements are disassembled when the packing device is transported or the like, the cushioning capability of the cushioning part drops.

SUMMARY

An aspect of the present disclosure is directed to a packing device including: an object to be packed; a packing box accommodating the object to be packed; and a cushioning part arranged between the object to be packed and an inner wall of the packing box and protecting the object to be packed from an external force applied to the packing box. The cushioning part includes a plurality of cushioning elements and the plurality of cushioning elements in an assembled state are configured to be disassembled by moving in a direction of disassembly. Each of the cushioning elements forming the cushioning part is in contact with the object to be packed or the inner wall of the packing box and thus has its movement in the direction of disassembly regulated.

In the packing device, at least one of the cushioning elements forming the cushioning part may have a multilayer structure formed of plate-like members stacked on each other.

In the packing device, the cushioning part may be arranged at a position overlapping a boundary between a plurality of faces of the object to be packed.

In the packing device, the cushioning part may be formed of the plurality of cushioning elements assembled together without using an adhesive material.

In the packing device, at least one of the cushioning elements forming the cushioning part may have a fitting part that is fitted with another one of the cushioning elements, and the movement of the cushioning element may be regulated by the fitting part.

In the packing device, the plate-like member may contain fiber dispersed within a plane, and the cushioning element having the multilayer structure may be arranged in such a direction that the external force is inputted from a direction along a surface of the plate-like member.

In the packing device, the cushioning elements may include a first cushioning element and a second cushioning element fitted with each other and assembled together and having the direction of disassembly in a first direction, and a third cushioning element fitted with the first cushioning element and the second cushioning element. The direction of disassembly of the third cushioning element from the first cushioning element and the second cushioning element may be orthogonal to the first direction.

In the packing device, the cushioning elements may include a first cushioning element, a second cushioning element and a third cushioning element fitted with and assembled to the first cushioning element and having the direction of disassembly in a first direction, and a fourth cushioning element fitted with the second cushioning element and the third cushioning element. The direction of disassembly of the fourth cushioning element from the second cushioning element and the third cushioning element may be orthogonal to the first direction.

In the packing device, the cushioning element having the multilayer structure may be arranged standing up in such a direction that a direction along a surface of the plate-like member is oriented along the first direction. The cushioning element having the multilayer structure may have a first support part held between the object to be packed and the packing box, in the first direction, and a second support part held between the object to be packed and the packing box, in a direction along the surface of the plate-like member and orthogonal to the first direction.

DESCRIPTION OF EXEMPLARY EMBODIMENTS

Embodiments of the present disclosure will now be described with reference to the accompanying drawings.

First Embodiment

Figure 1:
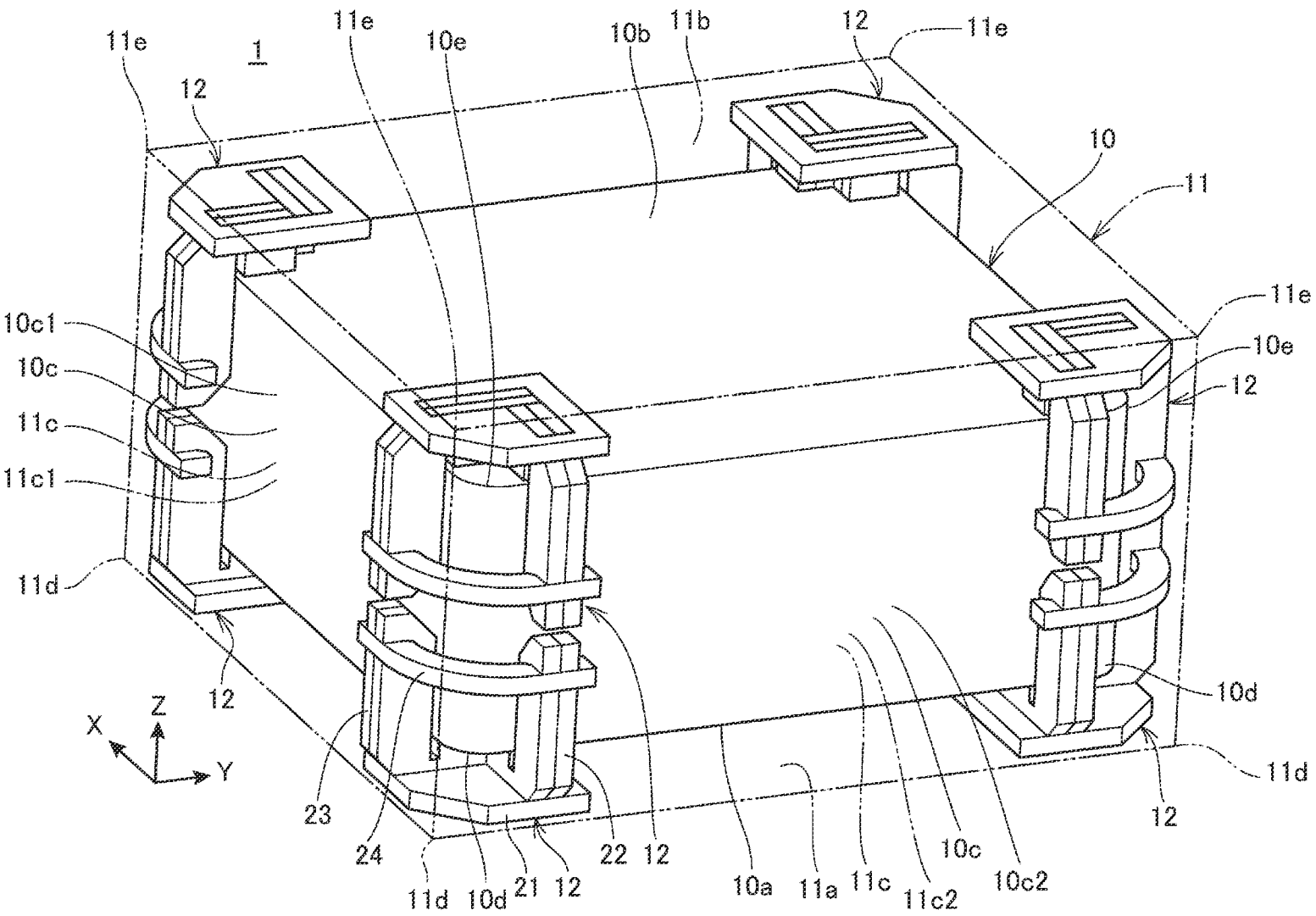
FIG. 1 is a perspective view of a packing device.

FIG. 1 is a perspective view of a packing device 1.

The packing device 1 has an object to be packed 10, a packing box 11 accommodating the object to be packed 10, and a cushioning part 12 arranged between the object to be packed 10 and the packing box 11.

The object to be packed 10 is an electronic apparatus. The object to be packed may be, for example, an electronic apparatus, a piece of furniture, a machine component, food, clothing or the like. However, the type of the object to be packed is not particularly limited. The electronic apparatus as the object to be packed is, for example, a printing device, a display device, a computer device, a projector or the like.

The object to be packed 10 is substantially hexahedral and has a bottom face 10*a*, a top face 10*b*, and four side faces 10*c* connecting the bottom face 10*a* and the top face 10*b*. Although the object to be packed 10 that is substantially hexahedral is described as an example, the object to be packed is not limited to a hexahedron.

The object to be packed 10 has four corner parts 10*d* on the side of the bottom face 10*a* and four corner parts 10*e* on the side of the top face 10*b*. The corner parts 10*d* and the corner parts 10*e* are vertex parts of the hexahedral object to be packed 10.

The packing box 11 is a hexahedral hollow box. In FIG. 1, the packing box 11 is indicated by an imaginary line. The packing box 11 is, for example, a rectangular parallelepiped but may be a cube.

The packing box 11 is formed in the shape of a box having a bottom wall part 11*a*, a top wall part 11*b* opposite the bottom wall part 11*a*, and four sidewall parts 11*c* connecting the bottom wall part 11*a* and the top wall part 11*b* in an up-down direction.

In the description and drawings below, the direction of the width of the packing box 11 is defined as an X-axis direction, the direction of the depth of the packing box 11 is defined as a Y-axis direction, and the up-down direction is defined as a Z-axis direction. The X-axis direction, the Y-axis direction, and the Z-axis direction are orthogonal to each other.

The object to be packed 10 is smaller in size than the packing box 11 and is accommodated inside the packing box 11. The object to be packed 10 is covered with the bottom wall part 11*a*, the top wall part 11*b*, and the four sidewall parts 11*c* of the packing box 11.

The object to be packed 10 may be covered with a bag such as a plastic bag and accommodated in this state in the packing box 11.

The cushioning part 12 is arranged between the inner wall of the packing box 11 and the object to be packed 10 and protects the object to be packed 10 from an external force applied to the packing box 11.

A plurality of the cushioning parts 12 are provided inside the packing box 11.

More specifically, the cushioning part 12 is provided at the inner side of each of four vertex parts 11*d* on the bottom wall part 11*a* side, of the eight vertex parts of the hexahedral packing box 11.

The cushioning part 12 is also provided at the inner side of each of four vertex parts 11*e* on the top wall part 11*b* side, of the eight vertex parts of the packing box 11. That is, the cushioning part 12 is arranged at eight positions inside the packing box 11.

The cushioning parts 12 have the same structure. Therefore, in this example, the cushioning part 12 arranged at the inner side of one vertex part 11*d* on the bottom wall part 11*a* side of the packing box 11 is described in detail.

As shown in FIG. 1, the side faces 10*c* of the object to be packed 10 include first side faces 10*c*1 extending in the direction of the width of the packing box 11 and second side faces 10*c*2 extending in the direction of the depth of the packing box 11. The first side face 10*c*1 and the second side face 10*c*2 are orthogonal to each other and coupled together at the part of this orthogonal intersection.

The sidewall parts 11*c* of the packing box 11 include first sidewall parts 11*c*1 extending in the direction of the width of the packing box 11, and second sidewall parts 11*c*2 extending in the direction of the depth of the packing box 11. The first sidewall part 11*c*1 and the second sidewall part 11*c*2 are orthogonal to each other and coupled together at the part of this orthogonal intersection.

The cushioning part 12 is arranged between the corner part 10*d* of the object to be packed 10 and the vertex part 11*d* of the packing box 11 and is held between the object to be packed 10 and the packing box 11.

More specifically, the cushioning part 12 is held between the bottom wall part 11*a*, the first sidewall part 11*c*1, and the second sidewall part 11*c*2 of the packing box 11, and the bottom face 10*a*, the first side face 10*c*1, and the second side face 10*c*2 of the object to be packed 10, at the inner side of the vertex part 11*d* of the packing box 11.

The corner part 10*d* of the object to be packed 10 is a part serving as a boundary between three faces, that is, the bottom face 10*a*, the first side face 10*c*1, and the second side face 10*c*2, which are the plurality of faces of the object to be packed 10. The cushioning part 12 overlaps this boundary.

Figure 2:
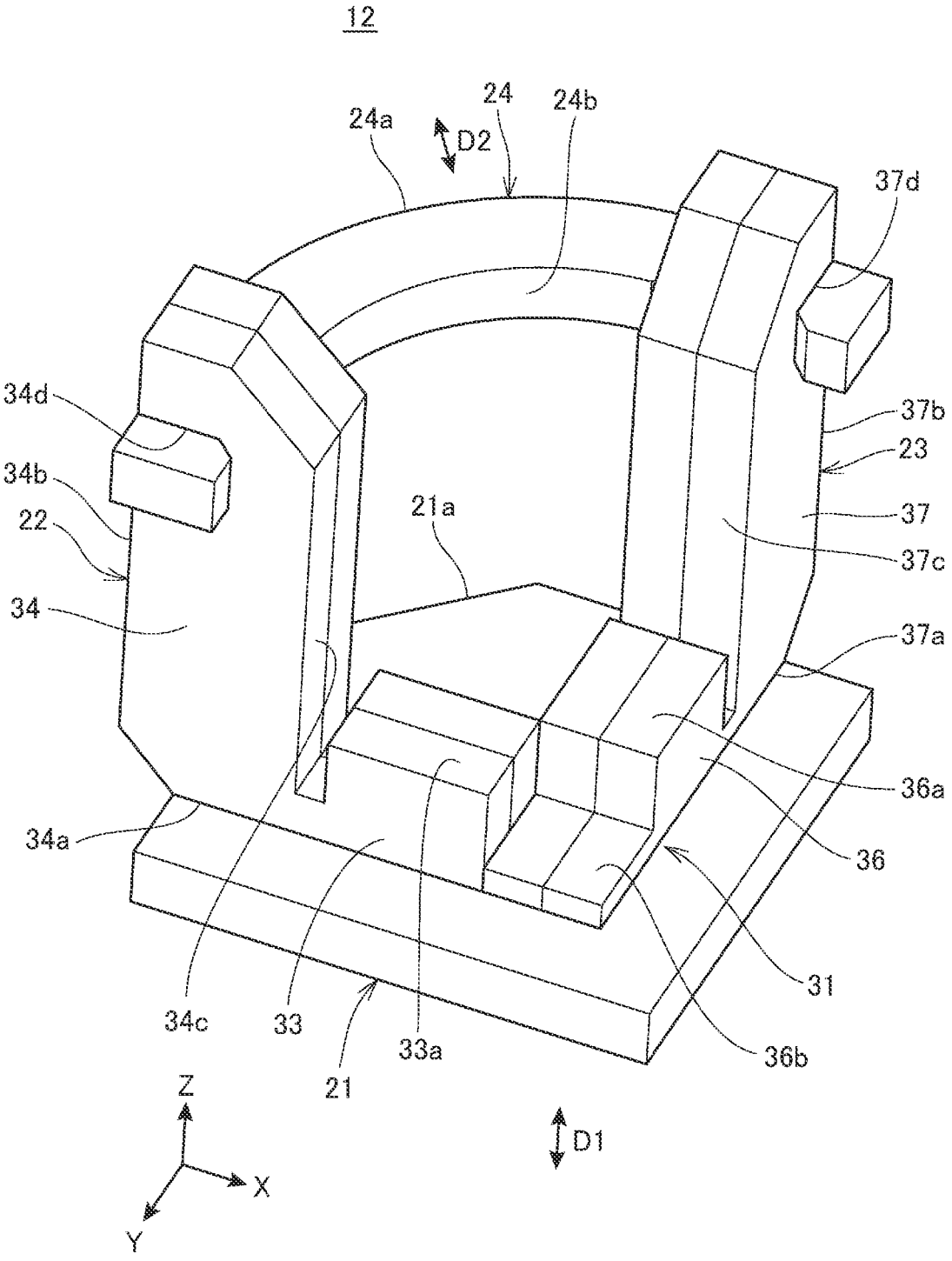
FIG. 2 is a perspective view of a cushioning part, as viewed from a corner of an object to be packed.
Figure 3:
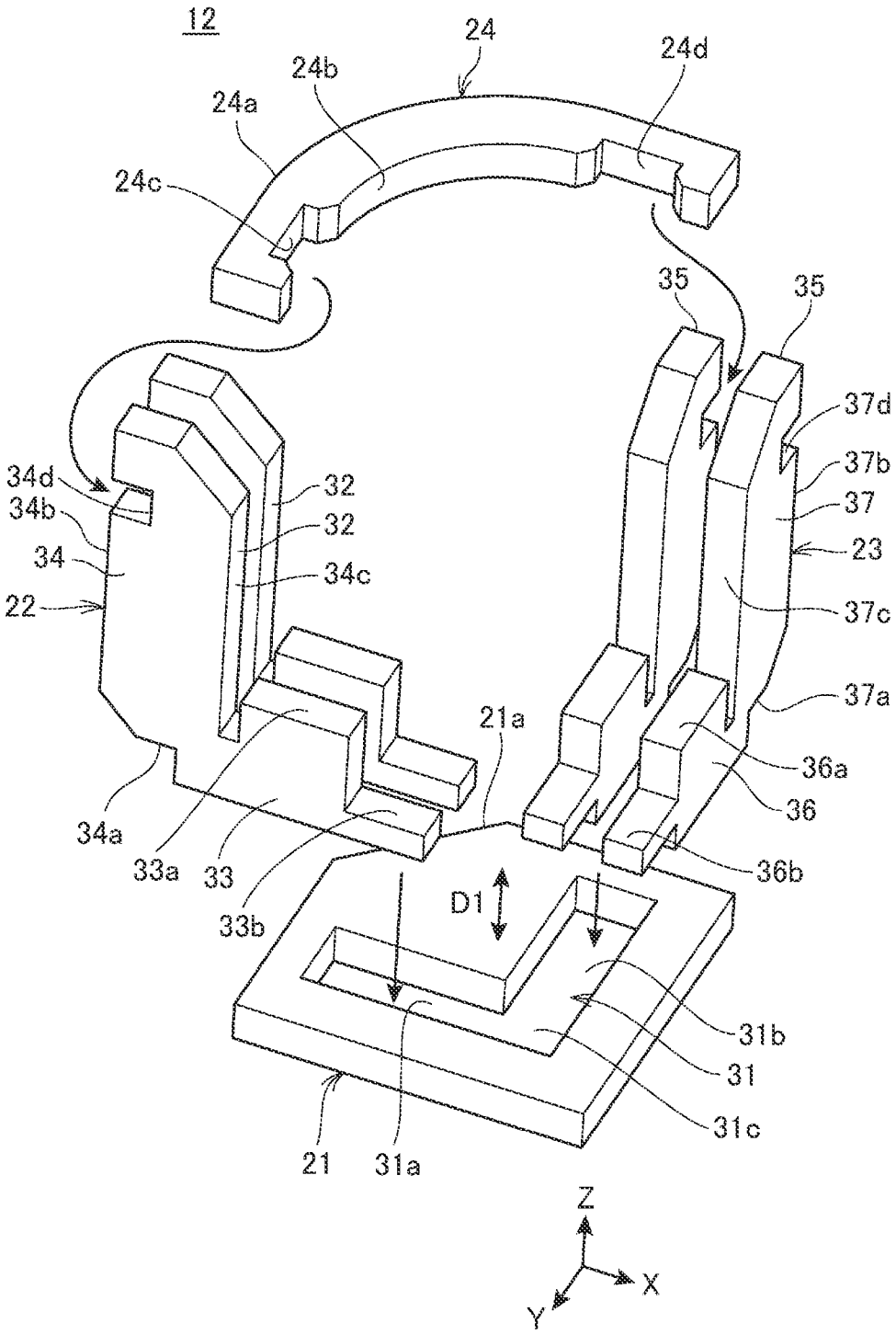
FIG. 3 is an exploded perspective view of the cushioning part.

FIG. 2 is a perspective view of the cushioning part 12, as viewed from the corner part 10*d* side of the object to be packed 10. FIG. 3 is an exploded perspective view of the cushioning part 12.

Referring to FIGS. 1 to 3, the cushioning part 12 is formed of a first cushioning element 21, a second cushioning element 22, a third cushioning element 23, and a fourth cushioning element 24 assembled together.

Each of the first cushioning element 21, the second cushioning element 22, the third cushioning element 23, and the fourth cushioning element 24 is a plate member and is made of paper. This paper is recycled paper formed in the shape of a plate by cutting used paper into small pieces, fibrillating the cut paper into a flocculated form, and compressing and binding the fibrillated fibers together. This paper contains a large number of fibers dispersed within the plane of the paper.

The cushioning part 12 is formed of a fitting structure in which the first cushioning element 21, the second cushioning element 22, the third cushioning element 23, and the fourth cushioning element 24 are fitted together. The cushioning part 12 is thus assembled without using an adhesive material.

The direction along the plate surface of the plate member forming the first cushioning element 21, the second cushioning element 22, the third cushioning element 23, and the fourth cushioning element 24 is referred to as a planar direction. The planar direction is orthogonal to the direction of the thickness of the plate member forming the first cushioning element 21, the second cushioning element 22, the third cushioning element 23, and the fourth cushioning element 24.

The first cushioning element 21, the second cushioning element 22, the third cushioning element 23, and the fourth cushioning element 24 are deformed by an external force and thus absorb its impact. The first cushioning element 21, the second cushioning element 22, the third cushioning element 23, and the fourth cushioning element 24 have a higher impact absorption capability in the planar direction of the plate member than in the direction of the thickness of the plate member.

The first cushioning element 21 is arranged in such a direction that the planar direction of the plate member is oriented along a horizontal direction. That is, the first cushioning element 21 is laid down in such a way that the direction of the thickness is oriented along an up-down direction. Here, the horizontal direction is the X-axis direction and the Y-axis direction. The up-down direction is the Z-axis direction.

The first cushioning element 21 is a plate member that is substantially rectangular as viewed in a plan view. At one of four corner parts of the first cushioning element 21 as viewed in a plan view, a chamfered part 21*a* avoiding the vertex part 11*d* of the packing box 11 is provided.

The first cushioning element 21 has a first fitting part 31 penetrating the first cushioning element 21 in the up-down direction.

The first fitting part 31 has a first slit part 31*a* extending in the direction of the width of the packing box 11, and a second slit part 31*b* extending in the direction of the depth of the packing box 11. The first slit part 31*a* and the second slit part 31*b* are orthogonal to each other. As viewed in a plan view, the first slit part 31*a* is parallel to the first sidewall part 11*c*1 of the packing box 11, and the second slit part 31*b* is parallel to the second sidewall part 11*c*2.

The first fitting part 31 is an L-shaped hole formed of the first slit part 31*a* and the second slit part 31*b* intersecting each other at an intersection part 31*c*. The intersection part 31*c* is located near a corner part that is diagonally opposite to the chamfered part 21*a*, of the four corner parts of the first cushioning element 21.

The second cushioning element 22 is located in such a direction that the planar direction of the plate member is oriented along the up-down direction. That is, the second cushioning element 22 is raised upright in such a way that the direction of the thickness is oriented along the horizontal direction. The second cushioning element 22 is arranged in such a direction that the planar direction is oriented along the direction of the width of the packing box 11, as viewed in a plan view.

More specifically, the second cushioning element 22 is a plate member having a multilayer structure formed of a plurality of plate-like members 32 stacked on each other in the direction of the thickness. The plurality of plate-like members 32 have the same shape. The plate-like members 32 are made of paper. The planar direction of the plate-like members 32 is the same as the planar direction of the second cushioning element 22.

The second cushioning element 22 has a first support part 33 extending horizontally along the bottom wall part 11*a* of the packing box 11, and a second support part 34 extending upward from one end part in the longitudinal direction of the first support part 33, and is formed substantially in an L-shape.

The second cushioning element 22 has a reception part 33*a* supporting the object to be packed 10 from below, between the second support part 34 and the other end part in the longitudinal direction of the first support part 33. The reception part 33*a* has a horizontal top surface.

At the other end part of the first support part 33, a step part 33*b* lower than the top surface of the reception part 33*a* is provided.

The second cushioning element 22 is inserted in the first fitting part 31 of the first cushioning element 21 from above. The first support part 33 is thus fitted in the first slit part 31*a*.

The second support part 34 of the second cushioning element 22 has, at a lower end part, a contact part 34*a* coming into contact with the top surface of the first cushioning element 21 from above.

The second support part 34 has an outer contact surface 34*b* extending in the up-down direction along the inner wall of the second sidewall part 11*c*2 of the packing box 11, and an inner contact surface 34*c*, which is a surface opposite to the outer contact surface 34*b* of the second support part 34.

The outer contact surface 34*b* and the inner contact surface 34*c* are surfaces forming the thickness of the second support part 34 and extend vertically.

At an upper part of the second support part 34, a recess part 34*d* formed of a part of the outer contact surface 34*b* recessed toward the inner contact surface 34*c* is provided.

The third cushioning element 23 is located in such a direction that the planar direction of the plate member is oriented along the up-down direction. That is, the third cushioning element 23 is raised upright in such a way that the direction of the thickness is oriented along the horizontal direction. The third cushioning element 23 is arranged in such a direction that the planar direction is oriented along the direction of the width of the packing box 11, as viewed in a plan view.

More specifically, the third cushioning element 23 is a plate member having a multilayer structure formed of a plurality of plate-like members 35 stacked on each other in the direction of the thickness. The plurality of plate-like members 35 have the same shape. The plate-like members 35 are made of paper. The planar direction of the plate-like members 35 is the same as the planar direction of the third cushioning element 23.

The third cushioning element 23 has a first support part 36 extending horizontally along the bottom wall part 11*a* of the packing box 11, and a second support part 37 extending upward from one end part in the longitudinal direction of the first support part 36, and is formed substantially in an L-shape.

The third cushioning element 23 has a reception part 36*a* supporting the object to be packed 10 from below, between the second support part 37 and the other end part 36*b* in the longitudinal direction of the first support part 36. The reception part 36*a* has a horizontal top surface.

The top surface of the other end part 36*b* of the first support part 36 is at a lower position than the top surface of the reception part 36*a*. The bottom surface of the other end part 36*b* is at a higher position than the bottom surface of the reception part 36*a*.

The third cushioning element 23 is inserted in the first fitting part 31 of the first cushioning element 21 from above. The first support part 36 is thus fitted in the second slit part 31*b*.

The second support part 37 of the third cushioning element 23 has, at a lower end part, a contact part 37*a* coming into contact with the top surface of the first cushioning element 21 from above.

The second support part 37 has an outer contact surface 37*b* extending in the up-down direction along the inner wall of the first sidewall part 11*c*1 of the packing box 11, and an inner contact surface 37*c*, which is a surface opposite to the outer contact surface 37*b* of the second support part 37.

The outer contact surface 37*b* and the inner contact surface 37*c* are surfaces forming the thickness of the second support part 37 and extend vertically.

At an upper part of the second support part 37, a recess part 37*d* formed of a part of the outer contact surface 37*b* recessed toward the inner contact surface 37*c* is provided.

The recess part 37*d* of the third cushioning element 23 and the recess part 34*d* of the second cushioning element 22 are at the same height.

The fourth cushioning element 24 is arranged in such a direction that the planar direction of the plate member is oriented along the horizontal direction. That is, the fourth cushioning element 24 is laid down in such a way that the direction of the thickness is oriented along the up-down direction.

The fourth cushioning element 24 is a plate member extending in the horizontal direction and coupling the second cushioning element 22 and the third cushioning element 23 together.

The fourth cushioning element 24 is formed in an L-shape along the first sidewall part 11*c*1 and the second sidewall part 11*c*2 of the packing box 11 at the vertex part 11*d*, as viewed in a plan view.

The fourth cushioning element 24 has an outer peripheral surface 24*a* facing the first sidewall part 11*c*1 and the second sidewall part 11*c*2, and an inner peripheral surface 24*b*, which is a surface opposite to the outer peripheral surface 24*a*. The outer peripheral surface 24*a* and the inner peripheral surface 24*b* are surfaces forming the thickness of the fourth cushioning element 24.

At one end part of the fourth cushioning element 24, a second fitting part 24*c* to be fitted with the recess part 34*d* of the second cushioning element 22 is provided. At the other end part of the fourth cushioning element 24, a second fitting part 24*d* to be fitted with the recess part 37*d* of the third cushioning element 23 is provided.

The second fitting part 24*c* and the second fitting part 24*d* are formed of a part of the inner peripheral surface 24*b* recessed toward the outer peripheral surface 24*a*.

The second cushioning element 22 has the first support part 33 fitted in the first slit part 31*a* from above and is thus assembled to the first cushioning element 21.

The third cushioning element 23 has the first support part 36 fitted in the second slit part 31*b* from above and is thus assembled to the first cushioning element 21.

That is, the direction of assembly of the second cushioning element 22 and the third cushioning element 23 to the first cushioning element 21 is the up-down direction.

Also, a direction of disassembly D1 of the second cushioning element 22 and the third cushioning element 23 from the first cushioning element 21 is the up-down direction. When the second cushioning element 22 and the third cushioning element 23 move upward from the first cushioning element 21, the fitting with the first fitting part 31 is cancelled and the first cushioning element 21, the second cushioning element 22, and the third cushioning element 23 are disassembled from each other.

The fourth cushioning element 24 has the second fitting part 24*c* fitted in the horizontal direction with the recess part 34*d* of the second cushioning element 22 and has the second fitting part 24*d* fitted in the horizontal direction with the recess part 37*d* of the third cushioning element 23, and is thus assembled to the second cushioning element 22 and the third cushioning element 23.

That is, the direction of assembly of the fourth cushioning element 24 to the second cushioning element 22 and the third cushioning element 23 is the horizontal direction.

Also, a direction of disassembly D2 of the fourth cushioning element 24 from the second cushioning element 22 and the third cushioning element 23 is the horizontal direction. When the fourth cushioning element 24 horizontally moves in the direction opposite to the direction of assembly of the fourth cushioning element 24, the fitting with the recess part 34*d* and the recess part 37*d* is cancelled.

The direction of disassembly D1, which is the up-down direction, is a first direction. The direction of disassembly D2, which is the horizontal direction, is a second direction. The direction of disassembly D1 and the direction of disassembly D2 are orthogonal to each other. However, the direction of disassembly D1 and the direction of disassembly D2 are not limited to being orthogonal to each other and may intersect each other.

In the state where the cushioning part 12 is assembled as shown in FIG. 2, the second cushioning element 22 and the third cushioning element 23 are orthogonal to each other, as viewed in a plan view. The direction of the thickness of the second cushioning element 22 and the direction of the thickness of the third cushioning element 23 are orthogonal to each other.

In the state where the cushioning part 12 is assembled, the other end part 36*b* of the third cushioning element 23 is laid on top of the step part 33*b* of the second cushioning element 22 from above and holds the second cushioning element 22 from above, at the intersection part 31*c* of the first fitting part 31.

In the state where the cushioning part 12 is assembled, the contact part 34*a* of the second cushioning element 22 and the contact part 37*a* of the third cushioning element 23 are laid on top of the first cushioning element 21 from above and hold the first cushioning element 21 from above.

The reception part 33*a* of the second cushioning element 22 and the reception part 36*a* of the third cushioning element 23 are at the same height.

Figure 4:
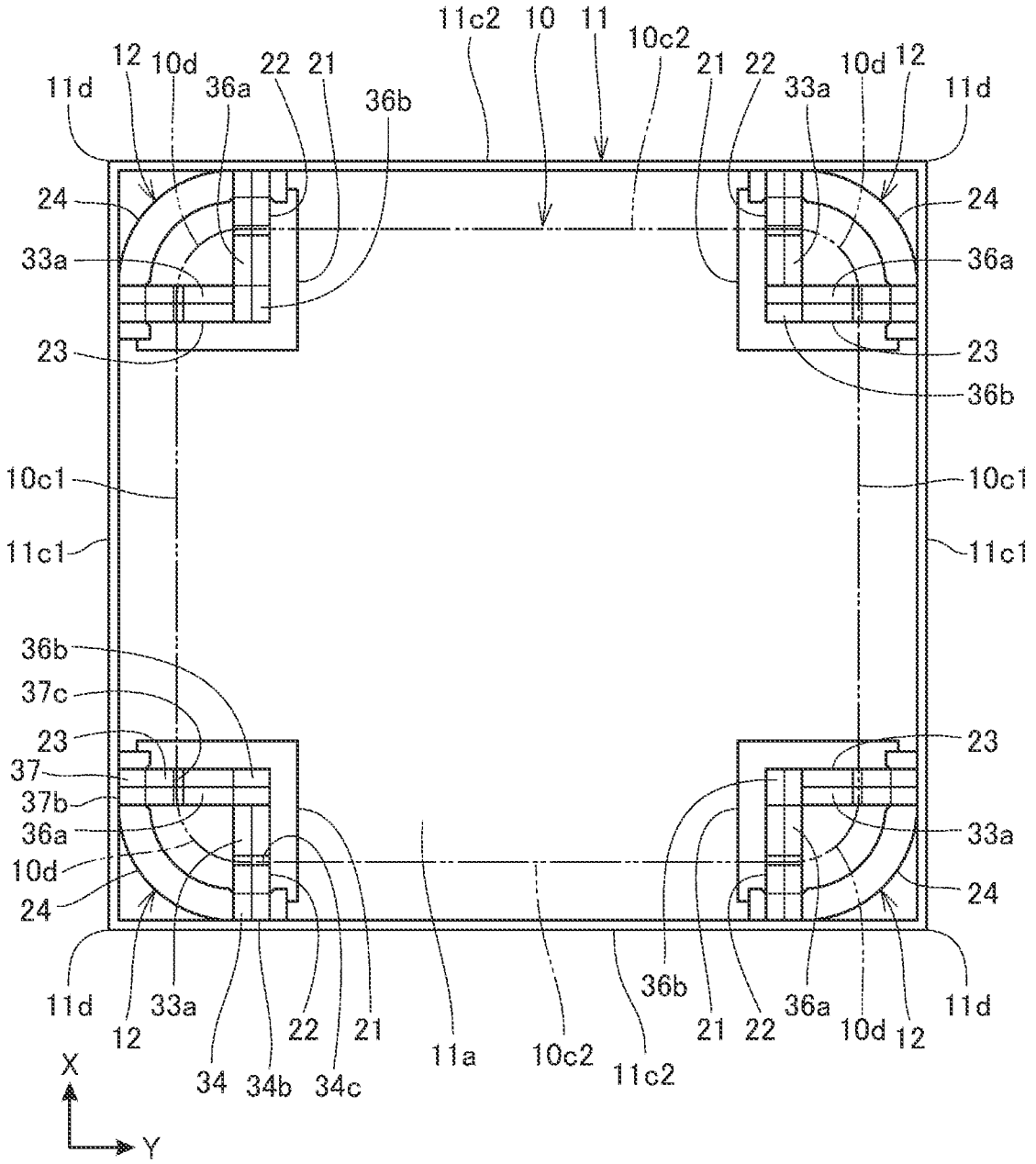
FIG. 4 is a plan view showing the support state of the object to be packed that is supported by the cushioning part at vertex parts of a packing box, as viewed from above.
Figure 5:
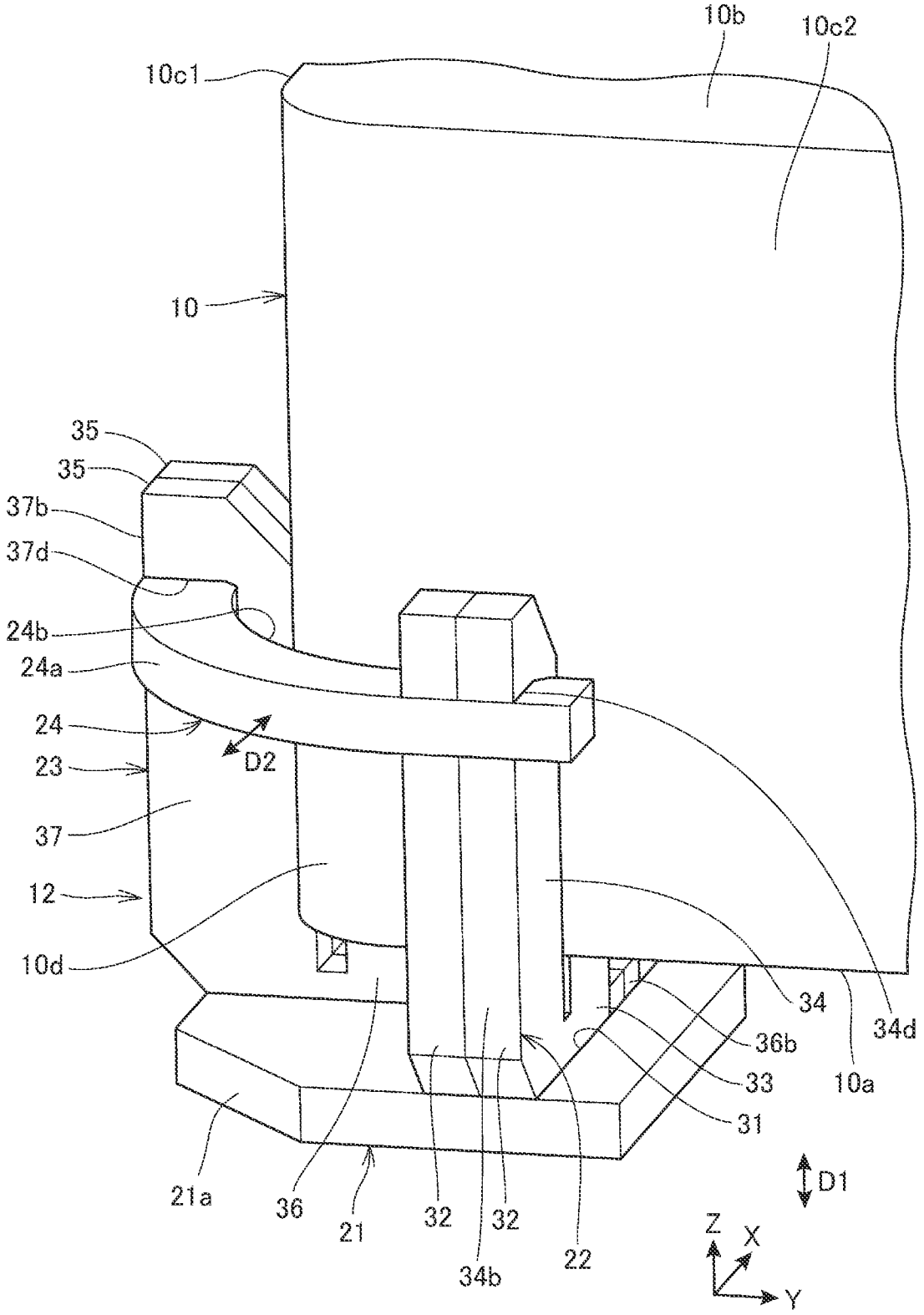
FIG. 5 is a perspective view showing the support state of the object to be packed that is supported by the cushioning part.

FIG. 4 is a plan view showing the support state of the object to be packed 10 supported by the cushioning part 12 at the vertex parts 11*d* of the packing box 11. FIG. 5 is a perspective view showing the support state of the object to be packed 10 supported by the cushioning part 12. In FIG. 5, the packing box 11 is not illustrated. In FIG. 5, the cushioning part 12 at the bottom left in FIG. 4 is described.

Referring to FIGS. 1 to 5, the cushioning part 12 is arranged on top of the bottom wall part 11*a* of the packing box 11, at the inner side of the vertex part 11*d*. The corner part 10*d* of the object to be packed 10 is placed on top of the cushioning part 12.

More specifically, the corner part 10*d* is supported from below by the reception part 33*a* of the first support part 33 of the second cushioning element 22 and the reception part 36*a* of the first support part 36 of the third cushioning element 23.

The first support part 33 and the first support part 36 are held in the up-down direction between the bottom wall part 11*a* of the packing box 11 and the bottom face 10*a* of the object to be packed 10 and receive an external force in the planar direction of the second cushioning element 22 and the third cushioning element 23.

The second cushioning element 22 and the third cushioning element 23 have a high impact absorption capability in the planar direction and therefore can effectively receive the external force. The external force includes a force acting on the packing box 11 from outside and a load due to the weight of the object to be packed 10. The external force acting on the packing box 11 acts on the cushioning part 12 mainly as a force in a direction substantially orthogonal to the outer surface of the packing box 11.

The object to be packed 10 is supported in the horizontal direction by the second support part 34 of the second cushioning element 22 held in the horizontal direction between the corner part 10*d* and the second sidewall part 11*c*2 of the packing box 11.

In the second support part 34, the outer contact surface 34*b* comes into contact with the inner wall of the second sidewall part 11*c*2 and the inner contact surface 34*c* comes into contact with the second side face 10*c*2 of the object to be packed 10.

The second support part 34 receives the external force acting on the packing box 11, in the planar direction of the second cushioning element 22. The second cushioning element 22 has a high impact absorption capability in the planar direction and therefore can effectively receive the external force.

The object to be packed 10 is also supported in the horizontal direction by the second support part 37 of the third cushioning element 23 held in the horizontal direction between the corner part 10*d* and the first sidewall part 11*c*1 of the packing box 11.

In the second support part 37, the outer contact surface 37*b* comes into contact with the inner wall of the first sidewall part 11*c*1 and the inner contact surface 37*c* comes into contact with the first side face 10*c*1 of the object to be packed 10.

The second support part 37 receives the external force acting on the packing box 11, in the planar direction of the third cushioning element 23. The third cushioning element 23 has a high impact absorption capability in the planar direction and therefore can effectively receive the external force.

The first cushioning element 21 is fitted with the second cushioning element 22 and the third cushioning element 23 via the first fitting part 31 and thus regulates the horizontal movement of the second cushioning element 22 and the third cushioning element 23. Thus, the second cushioning element 22 and the third cushioning element 23 are restrained from moving in the horizontal direction and becoming disassembled. In this way, the first fitting part 31 regulates the movement of the second cushioning element 22 and the third cushioning element 23 in a different direction from the direction of disassembly D1.

The first cushioning element 21 also holds the plurality of stacked plate-like members 32 via the first slit part 31*a* and thus maintains the multilayer structure of the plate-like members 32.

The first cushioning element 21 also holds the plurality of stacked plate-like members 35 via the second slit part 31*b* and thus maintains the multilayer structure of the plate-like members 35.

The second cushioning element 22 and the third cushioning element 23 have the first support part 33 and the first support part 36 held between the object to be packed 10 and the bottom wall part 11*a* and thus have their movement in the direction of disassembly D1 regulated.

The first cushioning element 21 is held between the contact part 34*a* of the second cushioning element 22 and the contact part 37*a* of the third cushioning element 23, and the bottom wall part 11*a*, and thus has its movement in the direction of disassembly D1 regulated.

Therefore, the disassembly of the first cushioning element 21, the second cushioning element 22, and the third cushioning element 23 can be restrained, using the object to be packed 10 and the inner wall of the packing box 11.

The fourth cushioning element 24 couples the second cushioning element 22 and the third cushioning element 23 together in the horizontal direction and thus regulates the horizontal movement of the second cushioning element 22 and the third cushioning element 23 and restrains the disassembly of the second cushioning element 22 and the third cushioning element 23 from each other.

The fourth cushioning element 24 also fits and holds the plurality of plate-like members 32 in the second fitting part 24*c* and thus maintains the multilayer structure of the plate-like members 32. Similarly, the fourth cushioning element 24 fits and holds the plurality of plate-like members 35 in the second fitting part 24*d* and thus maintains the multilayer structure of the plate-like members 35.

The fourth cushioning element 24 also regulates the separation of the second cushioning element 22 and the third cushioning element 23 in the direction of disassembly D1.

The fourth cushioning element 24 has the second fitting part 24*c* held between the recess part 34*d* of the second cushioning element 22 and the inner wall of the second sidewall part 11*c*2 and thus has its movement in the direction of disassembly D2 regulated. The fourth cushioning element 24 also has the second fitting part 24*d* held between the recess part 37*d* of the third cushioning element 23 and the inner wall of the first sidewall part 11*c*1 and thus has its movement in the direction of disassembly D2 regulated.

Therefore, the disassembly of the fourth cushioning element 24 from the second cushioning element 22 and the third cushioning element 23 can be restrained, using the inner wall of the packing box 11.

As shown in FIG. 1, on the inner side of the vertex part 11*e* on the top wall part 11*b* side of the packing box 11, the cushioning part 12 is arranged upside down in relation to the cushioning part 12 at the vertex part 11*d*. In this case, the cushioning part 12 is held in the up-down direction between the top wall part 11*b* of the packing box 11 and the top face 10*b* of the object to be packed 10 and is also held in the horizontal direction between the sidewall part 11*c* of the packing box 11 and the side face 10*c* of the object to be packed 10.

As described above, the packing device 1 according to the first embodiment has the object to be packed 10, the packing box 11 accommodating the object to be packed 10, and the cushioning part 12 arranged between the object to be packed 10 and the inner wall of the packing box 11 and protecting the object to be packed 10 from an external force applied to the packing box 11. The cushioning part 12 is formed of the first cushioning element 21, the second cushioning element 22, the third cushioning element 23, and the fourth cushioning element 24 assembled together. The cushioning part 12 in the assembled state can be disassembled by the first cushioning element 21, the second cushioning element 22, the third cushioning element 23, and the fourth cushioning element 24 moving in the direction of disassembly D1, D2. The second cushioning element 22 forming the cushioning part 12 has a multilayer structure formed of the plate-like members 32 stacked on each other. The third cushioning element 23 forming the cushioning part 12 has a multilayer structure formed of the plate-like members 35 stacked on each other.

The first cushioning element 21 is in contact with the inner wall of the packing box 11 and thus has its movement in the direction of disassembly D1 regulated.

The second cushioning element 22 and the third cushioning element 23 are in contact with the inner wall of the packing box 11 and the object to be packed 10 and thus have their movement in the direction of disassembly D1 regulated.

The fourth cushioning element 24 is in contact with the inner wall of the packing box 11 and thus has its movement in the direction of disassembly D2 regulated.

Therefore, the cushioning part 12 formed of the first cushioning element 21, the second cushioning element 22, the third cushioning element 23, and the fourth cushioning element 24 assembled together is in contact with the object to be packed 10 or the inner wall of the packing box 11 and has its movement in the direction of disassembly D1, D2 regulated and is thus retrained from disassembling. Thus, the disassembly of the second cushioning element 22 having the multilayer structure formed of the plate-like members 32 stacked on each other and the disassembly of the third cushioning element 23 having the multilayer structure formed of the plate-like members 35 stacked on each other can be restrained. Also, the disassembly of the first cushioning element 21 and the fourth cushioning element 24 can be restrained. Therefore, the packing device 1 can effectively protect the object to be packed 10.

The cushioning part 12 is arranged at the position overlapping the boundary between the bottom face 10*a*, the first side face 10*c*1, and the second side face 10*c*2, which are the plurality of faces of the object to be packed 10.

Therefore, the disassembly of the cushioning part 12 can be regulated in a plurality of directions and can be effectively restrained. Also, the cushioning part 12 can protect the object to be packed 10 over a broad range.

The cushioning part 12 is formed of the plurality of the first cushioning element 21, the second cushioning element 22, the third cushioning element 23, and the fourth cushioning element 24 assembled together without using an adhesive material.

Therefore, no adhering process is needed and the cushioning part 12 is manufactured easily. Also, for example, to dispose of the cushioning part 12, the cushioning part 12 can be disassembled by moving the first cushioning element 21, the second cushioning element 22, the third cushioning element 23, and the fourth cushioning element 24 in the direction of disassembly D1, D2. Thus, the cushioning part 12 can be easily disposed of.

The first cushioning element 21 forming the cushioning part 12 has the first fitting part 31 fitted with the second cushioning element 22 and the third cushioning element 23, which are other cushioning elements. The first fitting part 31 regulates the movement of the second cushioning element 22 and the third cushioning element 23.

The fourth cushioning element 24 forming the cushioning part 12 has the second fitting part 24*c* and the second fitting part 24*d* fitted with the second cushioning element 22 and the third cushioning element 23, which are other cushioning elements. The second fitting part 24*c* and the second fitting part 24*d* regulate the movement of the second cushioning element 22 and the third cushioning element 23.

Therefore, the first fitting part 31, the second fitting part 24*c*, and the second fitting part 24*d* regulate the movement of the second cushioning element 22 and the third cushioning element 23 and can effectively restrain the disassembly of the cushioning part 12.

The plate-like members 32 contain fibers dispersed within the plane. The second cushioning element 22 having the multilayer structure formed of the plate-like members 32 is arranged in such a direction that an external force is inputted from the planar direction of the plate-like members 32. Therefore, the second cushioning element 22 having the multilayer structure can receive the external force in the planar direction of the plate-like members 32 and thus can efficiently absorb the external force.

The plate-like members 35 contain fibers dispersed within the plane. The third cushioning element 23 having the multilayer structure formed of the plate-like members 35 is arranged in such a direction that an external force is inputted from the planar direction of the plate-like members 35.

Therefore, the third cushioning element 23 having the multilayer structure can receive the external force in the planar direction of the plate-like members 35 and thus can efficiently absorb the external force.

The cushioning members include the first cushioning element 21, the second cushioning element 22 and the third cushioning element 23 fitted with and assembled to the first cushioning element 21 and having the direction of disassembly D1, which is the first direction, and the fourth cushioning element 24 fitted with the second cushioning element 22 and the third cushioning element 23. The direction of disassembly D2 of the fourth cushioning element 24 from the second cushioning element 22 and the third cushioning element 23 is orthogonal to the first direction.

This configuration enables the fourth cushioning element 24 to regulate the movement of the second cushioning element 22 and the third cushioning element 23 in the first direction. Also, the first cushioning element 21 can regulate the movement of the second cushioning element 22 and the third cushioning element 23. Therefore, the disassembly of the cushioning part 12 can be restrained.

The second cushioning element 22 having the multilayer structure is arranged upright in such a direction that the planar direction of the plate-like members 32 is oriented along the first direction. The second cushioning element 22 has the first support part 33 held in the first direction between the object to be packed 10 and the packing box 11, and the second support part 34 held in a direction along the planar direction of the plate-like members 32 and orthogonal to the first direction between the object to be packed 10 and the packing box 11.

The third cushioning element 23 having the multilayer structure is arranged upright in such a direction that the planar direction of the plate-like members 35 is oriented along the first direction. The third cushioning element 23 has the first support part 36 held in the first direction between the object to be packed 10 and the packing box 11, and the second support part 37 held in a direction along the planar direction of the plate-like members 35 and orthogonal to the first direction between the object to be packed 10 and the packing box 11.

Therefore, the second cushioning element 22 and the third cushioning element 23, which have the multilayer structure, are held between the object to be packed 10 and the packing box 11 in the first direction and the direction orthogonal to the first direction and receive an external force in the planar direction of the plate-like members 32 and 35. Thus, the second cushioning element 22 and the third cushioning element 23, which have the multilayer structure, can effectively absorb the external force.

Second Embodiment

A second embodiment of the present disclosure will now be described with reference to the accompanying drawings. In the second embodiment, parts that are configured similarly to the first embodiment are denoted by the same reference signs and are not described further in detail.

In the first embodiment, the cushioning part 12 formed of the first cushioning element 21, the second cushioning element 22, the third cushioning element 23, and the fourth cushioning element 24 assembled together is described. In the second embodiment, a cushioning part 212 formed of a first cushioning element 221, a second cushioning element 222, and a third cushioning element 223 assembled together will be described.

Figure 6:
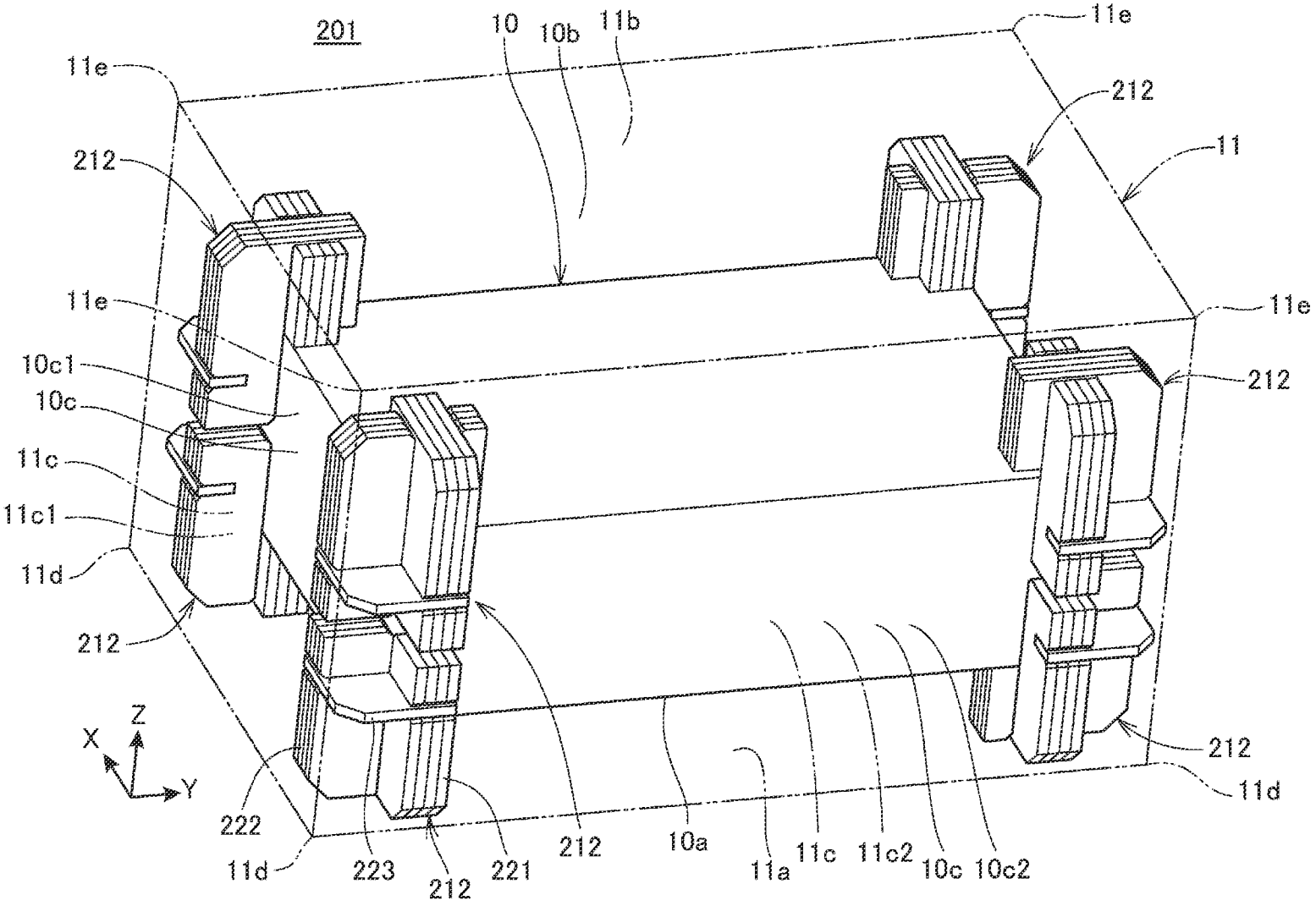
FIG. 6 is a perspective view of a packing device according to a second embodiment.

FIG. 6 is a perspective view of a packing device 201 according to the second embodiment.

The packing device 201 has the object to be packed 10, the packing box 11, and the cushioning part 212 arranged between the object to be packed 10 and the packing box 11.

The cushioning part 212 is provided at the inner side of each of the four vertex parts 11*d* on the bottom wall part 11*a* side.

The cushioning part 212 is also provided at the inner side of each of the four vertex parts 11*e* on the top wall part 11*b* side.

The cushioning parts 212 have the same structure. Therefore, in this example, the cushioning part 212 arranged at the inner side of one vertex part 11*d* on the bottom wall part 11*a* side of the packing box 11 is described in detail.

The cushioning part 212 is arranged between the corner part 10*d* of the object to be packed 10 and the vertex part 11*d* of the packing box 11 and is held between the object to be packed 10 and the packing box 11.

More specifically, the cushioning part 212 is held between the bottom wall part 11*a*, the first sidewall part 11*c*1, and the second sidewall part 11*c*2 of the packing box 11, and the bottom face 10*a*, the first side face 10*c*1, and the second side face 10*c*2 of the object to be packed 10, at the inner side of the vertex part 11*d* of the packing box 11.

The corner part 10*d* of the object to be packed 10 is a part serving as a boundary between the bottom face 10*a*, the first side face 10*c*1, and the second side face 10*c*2, which are the plurality of faces of the object to be packed 10. The cushioning part 212 overlaps this boundary.

Figure 7:
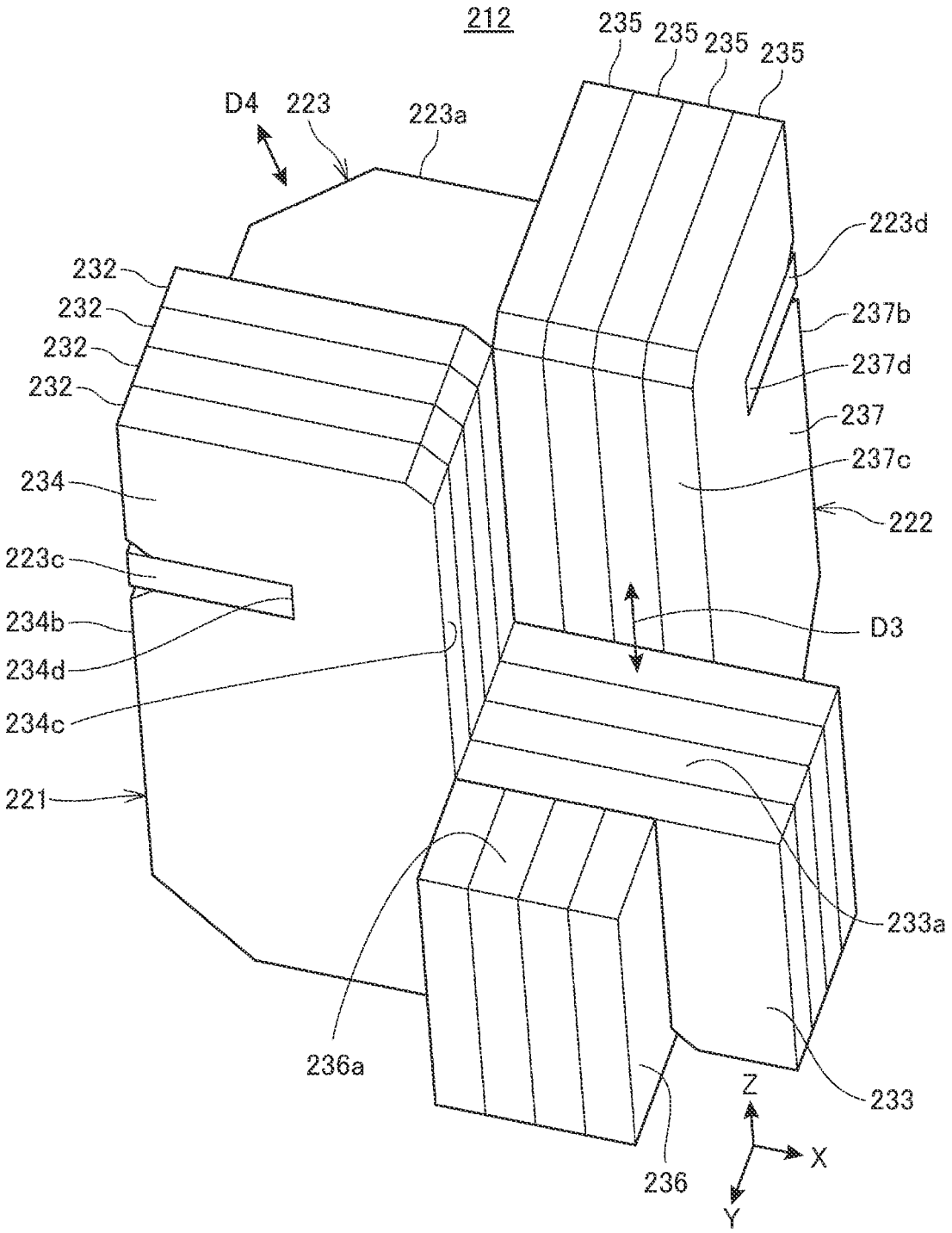
FIG. 7 is a perspective view of a cushioning part, as viewed from a corner of an object to be packed.
Figure 8:
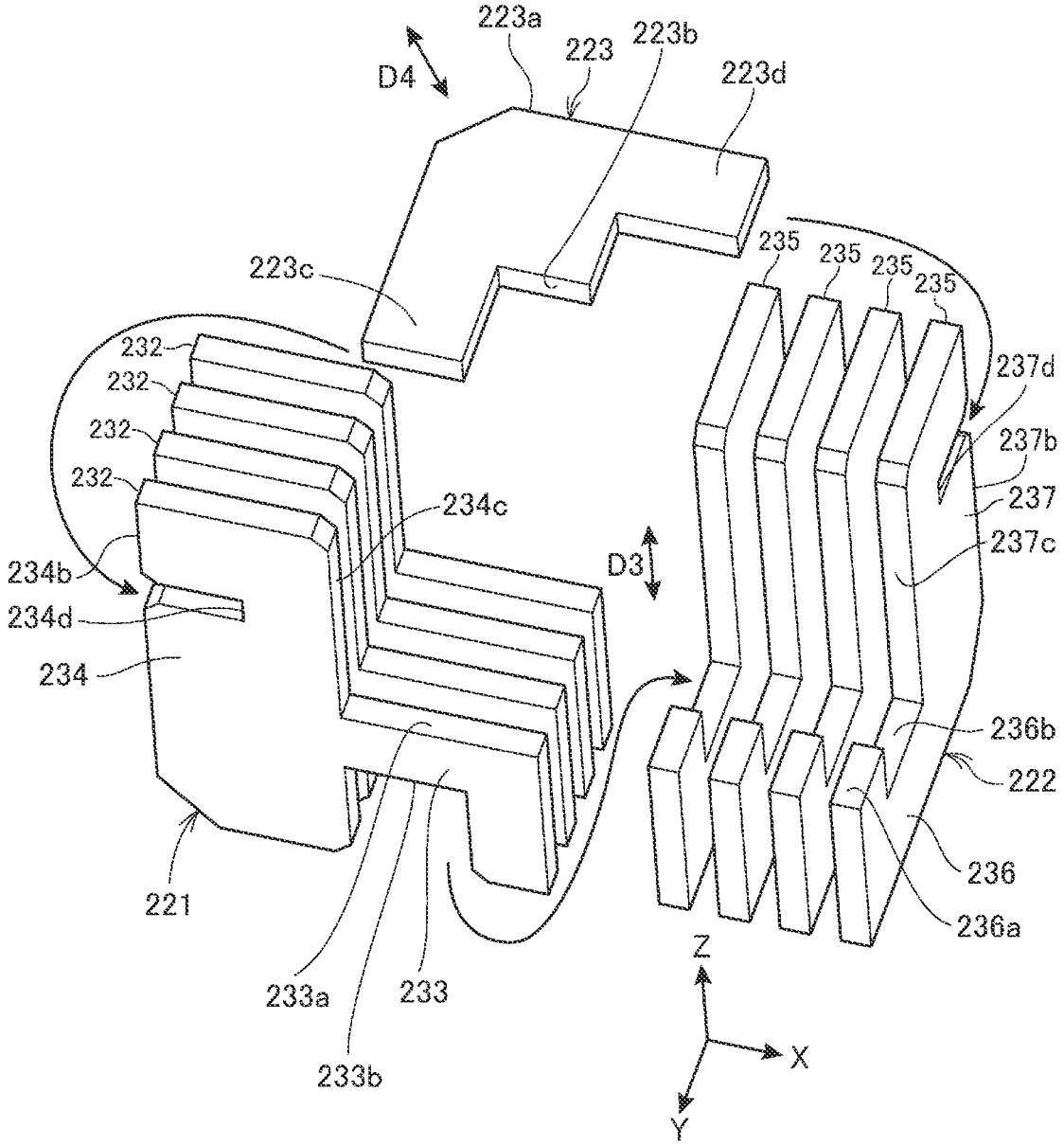
FIG. 8 is an exploded perspective view of the cushioning part.

FIG. 7 is a perspective view of the cushioning part 212, as viewed from the corner part 10*d* side of the object to be packed 10. FIG. 8 is an exploded perspective view of the cushioning part 212.

Referring to FIGS. 6 to 8, the cushioning part 212 is formed of the first cushioning element 221, the second cushioning element 222, and the third cushioning element 223 assembled together.

Each of the first cushioning element 221, the second cushioning element 222, and the third cushioning element 223 is a plate member and is made of the same paper as in the first embodiment.

The cushioning part 212 is formed of a fitting structure in which the first cushioning element 221, the second cushioning element 222, and the third cushioning element 223, are fitted together. The cushioning part 212 is thus assembled without using an adhesive material.

The direction along the plate surface of the plate member forming the first cushioning element 221, the second cushioning element 222, and the third cushioning element 223 is referred to as a planar direction. The planar direction is orthogonal to the direction of the thickness of the plate member forming the first cushioning element 221, the second cushioning element 222, and the third cushioning element 223.

The first cushioning element 221, the second cushioning element 222, and the third cushioning element 223 are deformed by an external force and thus absorb its impact. The first cushioning element 221, the second cushioning element 222, and the third cushioning element 223 have a higher impact absorption capability in the planar direction of the plate member than in the direction of the thickness of the plate member.

The first cushioning element 221 is located in such a direction that the planar direction of the plate member is oriented along the up-down direction. That is, the first cushioning element 221 is raised upright in such a way that the direction of the thickness is oriented along the horizontal direction. The first cushioning element 221 is arranged in such a direction that the planar direction is oriented along the direction of the width of the packing box 11, as viewed in a plan view.

More specifically, the first cushioning element 221 is a plate member having a multilayer structure formed of a plurality of plate-like members 232 stacked on each other in the direction of the thickness. The plurality of plate-like members 232 have the same shape. The plate-like members 232 are made of paper. The planar direction of the plate-like members 232 is the same as the planar direction of the first cushioning element 221.

The first cushioning element 221 has a first support part 233 extending horizontally along the bottom wall part 11*a* of the packing box 11, and a second support part 234 extending upward from one end part in the longitudinal direction of the first support part 233, and is formed substantially in an L-shape.

A top surface part of the first support part 233 is a reception part 233*a* supporting the object to be packed 10 from below.

The first cushioning element 221 has a first fitting part 233*b* formed by cutting out the first support part 233 upward from the bottom surface of the first support part 233. The first fitting part 233*b* is a rectangular recess part opening downward as viewed in the direction of the thickness of the first cushioning element 221.

The second support part 234 of the first cushioning element 221 extends upward in relation to the reception part 233*a*.

The second support part 234 has an outer contact surface 234*b* extending in the up-down direction along the inner wall of the second sidewall part 11*c*2 of the packing box 11, and an inner contact surface 234*c*, which is a surface opposite to the outer contact surface 234*b* of the second support part 234.

The outer contact surface 234*b* and the inner contact surface 234*c* are surfaces forming the thickness of the second support part 234 and extend vertically.

The second support part 234 is provided with a recess part 234*d* formed of a part of the outer contact surface 234*b* recessed toward the inner contact surface 234*c*.

The second cushioning element 222 is located in such a direction that the planar direction of the plate member is oriented along the up-down direction. That is, the second cushioning element 222 is raised upright in such a way that the direction of the thickness is oriented along the horizontal direction. The second cushioning element 222 is arranged in such a direction that the planar direction is oriented along the direction of the depth of the packing box 11, as viewed in a plan view.

More specifically, the second cushioning element 222 is a plate member having a multilayer structure formed of a plurality of plate-like members 235 stacked on each other in the direction of the thickness. The plurality of plate-like members 235 have the same shape. The plate-like members 235 are made of paper.

The second cushioning element 222 has a first support part 236 extending horizontally along the bottom wall part 11*a* of the packing box 11, and a second support part 237 extending upward from one end part in the longitudinal direction of the first support part 236, and is formed substantially in an L-shape.

A top surface part of the first support part 236 is a reception part 236*a* supporting the object to be packed 10 from below.

The second cushioning element 222 has a second fitting part 236*b* formed by cutting out the first support part 236 downward from the top surface of the first support part 236. The second fitting part 236*b* is a rectangular recess part opening upward as viewed in the direction of the thickness of the second cushioning element 222.

The second support part 237 of the second cushioning element 222 extends upward in relation to the reception part 236*a*.

The second support part 237 has an outer contact surface 237*b* extending in the up-down direction along the inner wall of the first sidewall part 11*c*1 of the packing box 11, and an inner contact surface 237*c*, which is a surface opposite to the outer contact surface 237*b* of the second support part 237.

The outer contact surface 237*b* and the inner contact surface 237*c* are surfaces forming the thickness of the second support part 237 and extend vertically.

The second support part 237 is provided with a recess part 237*d* formed of a part of the outer contact surface 237*b* recessed toward the inner contact surface 237*c*.

The recess part 237*d* of the second cushioning element 222 and the recess part 234*d* of the first cushioning element 221 are at the same height.

The third cushioning element 223 is arranged in such a direction that the planar direction of the plate member is oriented along the horizontal direction. That is, the third cushioning element 223 is laid down in such a way that the direction of the thickness is oriented along the up-down direction.

The third cushioning element 223 is a plate member extending in the horizontal direction and coupling the first cushioning element 221 and the second cushioning element 222 together.

The third cushioning element 223 is formed in an L-shape along the first sidewall part 11*c*1 and the second sidewall part 11*c*2 of the packing box 11 at the vertex part 11*d*, as viewed in a plan view.

The third cushioning element 223 has an outer peripheral surface 223*a* facing the first sidewall part 11*c*1 and the second sidewall part 11*c*2, and an inner peripheral surface 223*b*, which is a surface opposite to the outer peripheral surface 223*a*. The outer peripheral surface 223*a* and the inner peripheral surface 223*b* are surfaces forming the thickness of the third cushioning element 223.

One end part of the third cushioning element 223 is a third fitting part 223*c* to be fitted with the recess part 234*d* of the first cushioning element 221. The other end part of the third cushioning element 223 is a third fitting part 223*d* to be fitted with the recess part 237*d* of the second cushioning element 222.

As the first fitting part 233*b* is fitted with the second fitting part 236*b* from above, the first cushioning element 221 and the second cushioning element 222 are assembled together.

That is, the direction of assembly of the second cushioning element 222 to the first cushioning element 221 is the up-down direction.

Also, a direction of disassembly D3 of the first cushioning element 221 and the second cushioning element 222 from each other is the up-down direction. When the first cushioning element 221 moves upward from the second cushioning element 222, the fitting between the first fitting part 233*b* and the second fitting part 236*b* is cancelled and the first cushioning element 221 and the second cushioning element 222 are disassembled from each other.

The third cushioning element 223 has the third fitting part 223*c* fitted in the horizontal direction with the recess part 234*d* of the first cushioning element 221 and has the third fitting part 223*d* fitted in the horizontal direction with the recess part 237*d* of the second cushioning element 222. Thus, the third cushioning element 223 is assembled to the first cushioning element 221 and the second cushioning element 222.

That is, the direction of assembly of the third cushioning element 223 to the first cushioning element 221 and the second cushioning element 222 is the horizontal direction.

Also, a direction of disassembly D4 of the third cushioning element 223 from the first cushioning element 221 and the second cushioning element 222 is the horizontal direction. When the third cushioning element 223 horizontally moves in the direction opposite to the direction of assembly of the third cushioning element 223, the fitting with the recess part 234*d* and the recess part 237*d* is cancelled.

The direction of disassembly D3, which is the up-down direction, is a first direction. The direction of disassembly D4, which is the horizontal direction, is a second direction. The direction of disassembly D3 and the direction of disassembly D4 are orthogonal to each other. However, the direction of disassembly D3 and the direction of disassembly D4 are not limited to being orthogonal to each other and may intersect each other.

In the state where the cushioning part 212 is assembled as shown in FIG. 7, the first cushioning element 221 and the second cushioning element 222 are orthogonal to each other, as viewed in a plan view. The direction of the thickness of the first cushioning element 221 and the direction of the thickness of the second cushioning element 222 are orthogonal to each other.

In the state where the cushioning part 212 is assembled, the first fitting part 233*b* of the first cushioning element 221 is laid on top of the second fitting part 236*b* of the second cushioning element 222 from above and holds the second cushioning element 222 from above. In this state, the reception part 233*a* of the first cushioning element 221 and the reception part 236*a* of the second cushioning element 222 are horizontal and at the same height.

Referring to FIGS. 6 to 8, the cushioning part 212 is arranged on top of the bottom wall part 11*a* of the packing box 11, at the inner side of the vertex part 11*d*. The corner part 10*d* of object to be packed 10 is placed on top of the cushioning part 212.

More specifically, the corner part 10*d* is supported from below by the reception part 233*a* of the first support part 233 of the first cushioning element 221 and the reception part 236*a* of the first support part 236 of the second cushioning element 222.

The first support part 233 and the first support part 236 are held in the up-down direction between the bottom wall part 11*a* of the packing box 11 and the bottom face 10*a* of the object to be packed 10 and receive an external force in the planar direction of the first cushioning element 221 and the second cushioning element 222.

The first cushioning element 221 and the second cushioning element 222 have a high impact absorption capability in the planar direction and therefore can effectively receive the external force.

The object to be packed 10 is supported in the horizontal direction by the second support part 234 of the first cushioning element 221 held in the horizontal direction between the corner part 10*d* and the second sidewall part 11*c*2 of the packing box 11.

In the second support part 234, the outer contact surface 234*b* comes into contact with the inner wall of the second sidewall part 11*c*2 and the inner contact surface 234*c* comes into contact with the second side face 10*c*2 of the object to be packed 10.

The second support part 234 receives the external force acting on the packing box 11, in the planar direction of the first cushioning element 221. The first cushioning element 221 has a high impact absorption capability in the planar direction and therefore can effectively receive the external force.

The object to be packed 10 is also supported in the horizontal direction by the second support part 237 of the second cushioning element 222 held in the horizontal direction between the corner part 10*d* and the first sidewall part 11*c*1 of the packing box 11.

In the second support part 237, the outer contact surface 237*b* comes into contact with the inner wall of the first sidewall part 11*c*1 and the inner contact surface 237*c* comes into contact with the first side face 10*c*1 of the object to be packed 10.

The second support part 237 receives the external force acting on the packing box 11, in the planar direction of the second cushioning element 222. The second cushioning element 222 has a high impact absorption capability in the planar direction and therefore can effectively receive the external force.

The first cushioning element 221 and the second cushioning element 222 regulate the movement of each other by having the first fitting part 233*b* and the second fitting part 236*b* fitted with each other. Thus, the first cushioning element 221 and the second cushioning element 222 are restrained from moving in the horizontal direction and becoming disassembled. In this way, the first fitting part 233*b* and the second fitting part 236*b* regulate the movement of the first cushioning element 221 and the second cushioning element 222 in a different direction from the direction of disassembly D3.

The first cushioning element 221 also holds the plurality of stacked plate-like members 235 in the direction of the thickness in the recessed first fitting part 233*b* and thus maintains the multilayer structure of the plate-like members 235.

The second cushioning element 222 also holds the plurality of stacked plate-like members 232 in the direction of the thickness in the recessed second fitting part 236*b* and thus maintains the multilayer structure of the plate-like members 232.

The first cushioning element 221 and the second cushioning element 222 have the first support part 233 and the first support part 236 held between the object to be packed 10 and the bottom wall part 11*a* and thus have their movement in the direction of disassembly D3 regulated.

Therefore, the disassembly of the first cushioning element 221 and the second cushioning element 222 can be restrained, using the object to be packed 10 and the inner wall of the packing box 11.

The third cushioning element 223 couples the first cushioning element 221 and the second cushioning element 222 together in the horizontal direction and thus regulates the horizontal movement of the first cushioning element 221 and the second cushioning element 222 and restrains the disassembly of the first cushioning element 221 and the second cushioning element 222 from each other.

The third cushioning element 223 also regulates the separation of the first cushioning element 221 and the second cushioning element 222 in the direction of disassembly D3.

The third cushioning element 223 has the third fitting part 223*c* held between the recess part 234*d* of the first cushioning element 221 and the inner wall of the second sidewall part 11*c*2 and thus has its movement in the direction of disassembly D4 regulated.

The third cushioning element 223 also has the third fitting part 223*d* held between the recess part 237*d* of the second cushioning element 222 and the inner wall of the first sidewall part 11*c*1 and thus has its movement in the direction of disassembly D4 regulated.

Therefore, the disassembly of the third cushioning element 223 from the first cushioning element 221 and the second cushioning element 222 can be restrained, using the inner wall of the packing box 11.

As described above, the packing device 201 according to the second embodiment has the object to be packed 10, the packing box 11 accommodating the object to be packed 10, and the cushioning part 212 arranged between the object to be packed 10 and the inner wall of the packing box 11 and protecting the object to be packed 10 from an external force applied to the packing box 11. The cushioning part 212 is formed of the first cushioning element 221, the second cushioning element 222, and the third cushioning element 223 assembled together. The cushioning part 212 in the assembled state can be disassembled by the first cushioning element 221, the second cushioning element 222, and the third cushioning element 223 moving in the direction of disassembly D3, D4. The first cushioning element 221 forming the cushioning part 212 has a multilayer structure formed of the plate-like members 232 stacked on each other. The second cushioning element 222 forming the cushioning part 212 has a multilayer structure formed of the plate-like members 235 stacked on each other.

The first cushioning element 221 is in contact with the object to be packed 10 and thus has its movement in the direction of disassembly D3 regulated.

The second cushioning element 222 is in contact with the inner wall of the packing box 11 and thus has its movement in the direction of disassembly D3 regulated.

The third cushioning element 223 is in contact with the inner wall of the packing box 11 and thus has its movement in the direction of disassembly D4 regulated.

Therefore, the cushioning part 212 formed of the first cushioning element 221, the second cushioning element 222, and the third cushioning element 223 assembled together is in contact with the object to be packed 10 or the inner wall of the packing box 11 and has its movement in the directions of disassembly D3, D4 regulated and is thus retrained from disassembling. Thus, the disassembly of the first cushioning element 221 having the multilayer structure formed of the plate-like members 232 stacked on each other and the disassembly of the second cushioning element 222 having the multilayer structure formed of the plate-like members 235 stacked on each other can be restrained. Also, the disassembly of the third cushioning element 223 can be restrained. Therefore, the packing device 201 can effectively protect the object to be packed 10.

The cushioning members include the first cushioning element 221 and the second cushioning element 222 fitted with and assembled to each other and having the direction of disassembly D3, which is the first direction, and the third cushioning element 223 fitted with the first cushioning element 221 and the second cushioning element 222. The direction of disassembly D4 of the third cushioning element 223 from the first cushioning element 221 and the second cushioning element 222 is orthogonal to the first direction.

This configuration enables the third cushioning element 223 to regulate the movement of the first cushioning element

221 and the second cushioning element 222 in the first direction. Therefore, the disassembly of the cushioning part 212 can be restrained.

The foregoing embodiments are preferable embodiments of the present disclosure. However, the present disclosure is not limited to these embodiments and can be modified in various manners without departing from the spirit and scope of the present disclosure.

For example, while the second cushioning element 22 and the third cushioning element 23 have a multilayer structure in the above description, for example, the first cushioning element 21 and the fourth cushioning element 24, too, may have a multilayer structure formed of plate-like members stacked on each other.

While the cushioning part 12 is arranged at the corner part 10*d* in the above description, the present disclosure is not limited to this example. The cushioning part may be arranged at a boundary between two faces. For example, the cushioning part may be arranged at a ridge part where the bottom face 10*a* and the side face 10*c* of the object to be packed are coupled together. The ridge part is, for example, the boundary between the bottom face 10*a* and the side face 10*c*.

What is claimed is:

1. A packing device, comprising:

an object;

a packing box accommodating the object; and a cushioning part arranged between the object and an inner wall of the packing box and protecting the object from an external force applied to the packing box, wherein the cushioning part includes a first cushioning element, a second cushioning element, a third cushioning element, and a fourth cushioning element, the second cushioning element and the third cushioning element are fitted with and assembled to the first cushioning element, the assembled second cushioning element and the assembled third cushioning element are configured to be disassembled by moving in a first direction, the fourth cushioning element is fitted with and assembled to the second cushioning element and the third cushioning element, each of the first cushioning element, the second cushioning element, the third cushioning element, and the fourth cushioning element in an assembled state is configured to be in contact with the object and to the inner wall of the packing box, and a direction of disassembly of the fourth cushioning element from the second cushioning element and the third cushioning element is orthogonal to the first direction.

2. The packing device according to claim 1, wherein the second cushioning element has a multilayer structure formed of plate-like members stacked on each other in a thickness direction which is orthogonal to the first direction, and the third cushioning element has the multilayer structure formed of the plate-like members stacked on each other in the thickness direction which is orthogonal to the first direction.

3. The packing device according to claim 1, wherein the cushioning part is arranged at a position overlapping a boundary between a plurality of faces of the object.

4. The packing device according to claim 1, wherein the first cushioning element, the second cushioning element, the third cushioning element, and the fourth cushioning element are assembled without using an adhesive material.

5. The packing device according to claim 1, wherein at least one of the first cushioning element or the fourth cushioning element has a fitting part configured to be.

6. The packing device according to claim 2, wherein at least one of the second cushioning element or the third cushioning element has the plate-like members containing a fiber dispersed within a plane, and the plate-like members containing the fiber is arranged such that the external force is applied in a direction along a surface of the plate-like members.

* * * * *